US006662757B2

(12) United States Patent
Lesage

(10) Patent No.: US 6,662,757 B2
(45) Date of Patent: Dec. 16, 2003

(54) EXPLOSION PROOF GAS-FIRED WATER HEATER

(75) Inventor: Claude Lesage, Pointe Claire (CA)

(73) Assignee: Giant Factories Inc., Montreal (CA)

( * ) Notice: Subject to any disclaimer, the term of this patent is extended or adjusted under 35 U.S.C. 154(b) by 0 days.

(21) Appl. No.: 10/234,140

(22) Filed: Sep. 5, 2002

(65) Prior Publication Data

US 2003/0150404 A1 Aug. 14, 2003

(30) Foreign Application Priority Data

Feb. 14, 2002 (CA) ..... 2371848

(51) Int. Cl.[7] ..... F22B 5/00
(52) U.S. Cl. ..... 122/14.21; 122/14.1; 122/14.2
(58) Field of Search ..... 122/13.01, 14.1, 122/14.2, 14.21

(56) References Cited

U.S. PATENT DOCUMENTS 4,509,913 A * 4/1985 Lorenz et al. ..... 431/90
5,797,355 A * 8/1998 Bourke et al. ..... 122/14.21
6,390,028 B1 * 5/2002 Langmead et al. ..... 122/14.2

* cited by examiner

*Primary Examiner*—Jiring Lu
(74) *Attorney, Agent, or Firm*—Ogilvy Benault; Guy J. Houle

(57) ABSTRACT

An explosion proof gas-tired water heater is comprised of a housing having a water reservoir provided with a sealed combustion chamber thereunder. A flue pipe is disposed above the combustion chamber and extends through the reservoir. A gas burner and pilot are provided in the combustion chamber. At least one air supply channel is provided to supply fresh air to the combustion chamber. The air supply channel has an intake disposed a predetermined height above the floor to prevent combustible vapors from entering the combustion chamber. Vapor detectors and/or pressure sensors may be provided as added features to detect the presence of combustible vapors as well as the production of harmful carbon monoxide in the combustion chamber and to actuate the gas supply cut-off valve.

9 Claims, 6 Drawing Sheets

EXPLOSION PROOF GAS-FIRED WATER HEATER

TECHNICAL FIELD

The present invention relates to an explosion proof gas-fired water heater whereby to shut off the gas burner and pilot upon the detection of abnormal life-threatening conditions in the vicinity of the gas-fired water heater.

BACKGROUND ART

Gas-fired water heaters can be hazardous if these are utilized in areas where there is a risk that combustible vapors may propagate in the area of such burners. Usually combustible vapors will accumulate on a floor surface and slowly build up and rise thus creating a large area of ignitable gas vapors. If such a cloud of vapors propagates into the combustion chamber of a gas-fired water heater they will ignite and cause a very serious explosion and usually destroying the gas-fired water heater and fragmenting the gas line to add further fuel to the fire. Needless to say, such explosion would be disastrous to any person in the immediate vicinity of the gas-fired water heater.

Another disadvantage of gas-fired water heaters is that they are usually installed in garages where fumes are released by automobiles due to gas leakage or paint, glues and other such combustible vapor generating products that we find in workshops where such items are usually stored. The basement is another hazardous location where we find these products. Various attempts have been made to deal with this problem but none have proven satisfactory.

A still further problem with gas-fired water heaters is that the air intake for the combustion chamber can become obstructed diminishing the supply of oxygen thus causing carbon monoxide which can seep into the air through the draft hood causing death to the residents.

SUMMARY OF INVENTION

It is a feature of the present invention to provide an explosion proof gas-tired water heater and wherein the supply of fresh air to the combustion chamber is made through at least one supply channel with the combustion chamber being sealed. One or more vapor detectors are associated with the channel to detect the presence of combustible vapors and the detectors operate switches to shut off the gas burner and pilot before the combustible vapors reach the gas burner and pilot through the air supply channel.

Another feature of the present invention is also to delay the propagation of the combustible vapors to the gas burner and pilot by disposing the intake port of the air supply channel at a predetermined distance elevated from the floor surface so that the combustion chamber has sufficient time to cool before the vapors can propagate into the combustion chamber through the supply channel.

Another feature of the present invention is to provide a gas-fired water heater wherein the fresh air intake port is provided in a support base of the water heater and wherein baffle walls are spaced from the intake port and the combustion chamber to delay the propagation of combustible vapors to the combustion chamber and further wherein the vapor detectors are disposed adjacent the fresh air intake port.

Another feature is to additionally provide a baffle and air dispenser perforated wall about the combustion chamber to optimize gas combustion.

A still further feature is to position the intake port of the supply channel substantially elevated from a floor surface such that explosive vapor clouds do not rise to the intake port to cause an explosion in the sealed combustion chamber.

A further feature is to provide a flame arrestor at the intake of the supply channel where it is easy to service and clean to ensure good supply of oxygen for the combustion.

Another feature is to provide a pressure detector in the supply channel to shut off the gas supply to the burner and pilot in the sealed combustion chamber should the supply channel intake become blocked or partly blocked to supply sufficient oxygen.

According to the above features, from a broad aspect, the present invention provides an explosion proof gas-fired water heater having a housing provided with a water reservoir and a sealed combustion chamber thereunder. A flue pipe is disposed above the combustion chamber and extends through the reservoir. A gas burner and pilot are provided in the combustion chamber. A gas supply line having a gas having gas supply shut-off valve is secured to the burner and pilot. A sealed combustible air channel lies fresh air to the combustion chamber and has an air supply intake disposed elevated from a floor surface of the water heater a distance of at least 40 inches whereby combustible vapors will not propagate to the air supply intake to enter the combustion chamber and reach the gas burner and pilot through the air supply channel. One or more vapor detectors are associated with the channel to detect the presence of combustible vapors. The vapor detectors are connected to a switching means to shut-off the gas burner and pilot before the combustible vapors reach the gas burner and pilot through the air supply channel.

BRIEF DESCRIPTION OF DRAWINGS

The preferred embodiments of the present invention will now be described with reference to the accompanying drawings in which.

DESCRIPTION OF PREFERRED EMBODIMENTS

Figure 1:
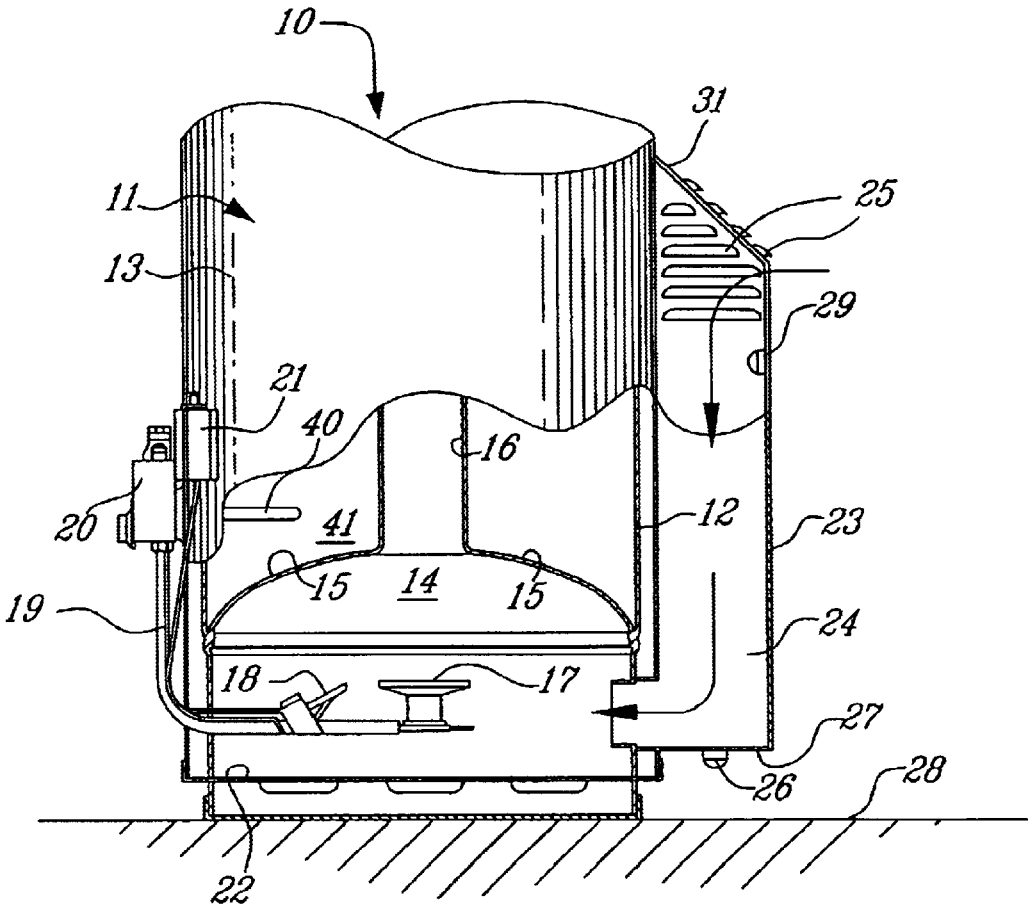
FIG. 1 is a partly fragmented aide view showing the construction of a gas-fired water heater incorporating the present invention and wherein the fresh air supply channel is constituted by one or more vertical conduits.

Referring now to FIG. 1, there is shown generally at 10 an explosion proof gas-fired water heater constructed in accordance with the present invention. The gas-fired water heater comprises a housing 11 having an inner tank 12 and an outer wall 13 which is spaced from the inner tank and insulated by an insulating material disposed between the outer wall and inner tank. A combustion chamber 14 is disposed under the bottom wall 15 of the inner tank. A flue 16 extends through the inner tank for the discharge of combustible product and to heat the water in the inner tank, as is well known in the art.

The combustion chamber 14 is provided with a gas burner 17 and a pilot 18. The pilot 18 and the burner 17 are supplied gas through the supply gas line 19 through a gas valve 20. A spark ignition system 21 or equivalent is provided to ignite the pilot 18.

With the present invention the combustion chamber is provided with a sealed bottom wall 22 in one of its embodiments. The fresh air necessary to provide combustion is supplied through one or more supply channels 23. As herein shown, the supply channel 23 is a vertical housing provided with sealed surrounding walls 24 and connected to the outer wall 13 of the water heater. The fresh air intake louvers 25 are disposed in an upper section of the supply channel 23. A flammable vapor detector 26 is hereinshown as secured to a bottom wall 27 of the supply channel 23 whereby to detect combustible vapors adjacent the floor surface 28 on which the hot water heater 10 is mounted. Accordingly, if dangerous combustible vapors accumulate they will be detected early before they rise to the fresh air intake louvers 25. As soon as the vapor detector 26 detects such vapors it will shut off the supply of gas by actuating the gas valve 20 as will be described later. As a safety feature a further flammable vapor detector 29 is located close to the fresh air intake.

The length of the supply channel 23 may vary dependent on the type of burners being used whereby upon detection of gas adjacent the floor area sufficient time will elapse before the combustible vapors reach the combustion chamber as they have to rise to the fresh air intake louvers and then down through the supply channel to the combustion chamber and this can take sometimes an hour or more. After the burner and pilot are extinguished by the actuation of the gas valve to place it in a closed condition the heat within the combustion chamber and flue will cause a draft through the flue bringing in fresh air to cool the combustion chamber whereby to prevent any hot surfaces to become in contact with the combustible vapors if they eventually propagate into the combustion chamber.

Figure 2:
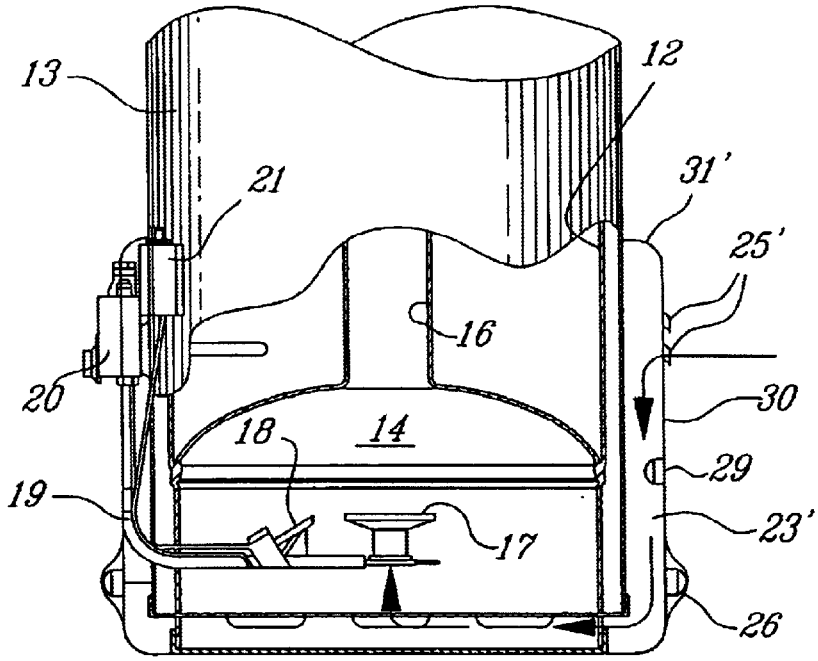
FIG. 2 is a view similar to FIG. 1 but with the conduit differently shaped and the vapor detectors disposed slightly differently.

FIG. 2 is a view similar to FIG. 1 and as can be seen the fresh air intake louvers 25' are disposed on the side wall 30 of the supply channel 23'. Also the flammable vapor detectors 26 and 29 are disposed at different locations simply to illustrate that various constructions of such fresh air supply channels are possible. As can be seen in both FIG. 1 and FIG. 2 the top walls 31 and 31' are sloped whereby to prevent the placement of foreign articles onto these stop walls which could obstruct the fresh air intake louvers or prevent someone placing a piece of cloth or rag which may be soaked with a flammable liquid such as turpentine or kerosene as we usually find in workshops or garages to cause a fire.

Figure 3:
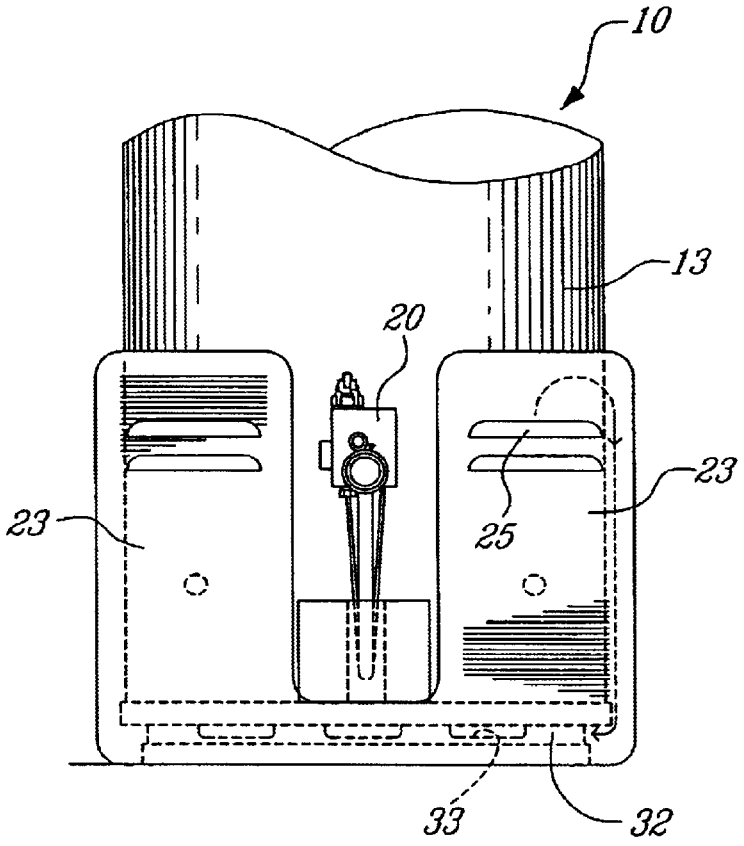
FIG. 3 is a fragmented side view showing a gas-fired water heater provided with two vertical fresh air conduits.

Referring now to FIG. 3 it illustrates that the hot water heater may be provided with two or more supply channels 23 about the gas-fired water heater. As hereinshown the flow of fresh air enters the louvers 25 and propagates into the supply channel 23 between the outer casing or wall 13 and down into the support base 32 of the gas-fired water heater. The support base is a sealed base and it is provided with air intake ports 33 which directly feed the combustion chamber. The intake ports are provided all about the support base 32.

Figure 4A:
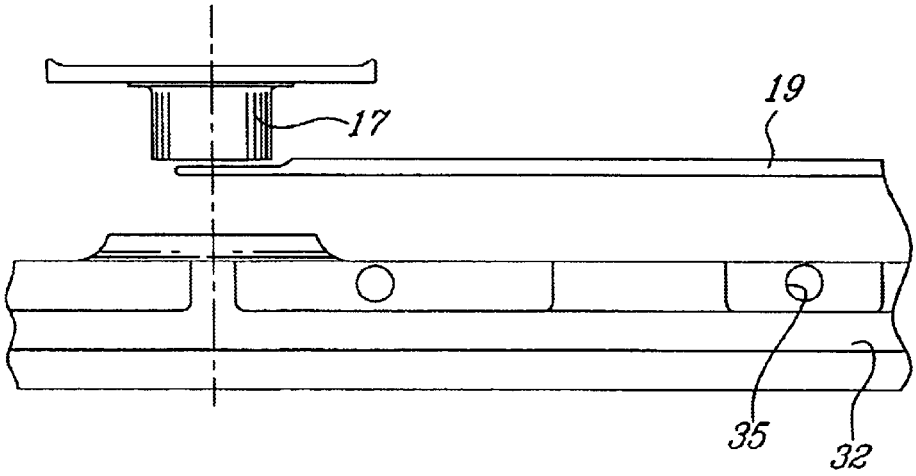
FIG. 4A is a fragmented side view showing a still further embodiment of the present invention and wherein the support base of the gas-fired water heater is provided with air intake ports and baffle plates to delay the propagation of combustible vapors and wherein one or more vapor detectors are secured adjacent the air intake ports.
Figure 4B:
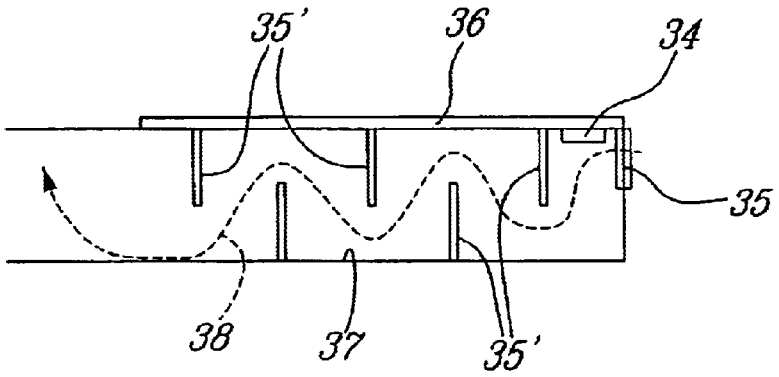
FIG. 4B is a section view of the base showing the disposition of a baffle plate.

As shown if FIGS. 4A and 4B the support base 32 is in contact with outside air. Such a support base may be used with gas burners of low capacity wherein the combustion chamber cools very quickly. However, in order to detect combustible vapors and to retard their propagation to the combustion chamber, vapor detectors 34 are disposed immediately adjacent the air intake ports 35 of the base 32. Furthermore, baffle walls 35' in the form of concentric rings are secured spaced apart from one another and extend from a top wall 36 and a bottom wall 37 of the base. Accordingly, the air entering the air intake port must propagate about these walls before reaching the combustion chamber, as is shown by the dotted line 38. As soon as the sensor 34 detects the presence of combustible vapors it will shut off the gas burner 17 and pilot 18. This embodiment is disclosed to show a further version of the present invention but the preferred version is the one as illustrated in FIGS. 1–3.

Figure 5:
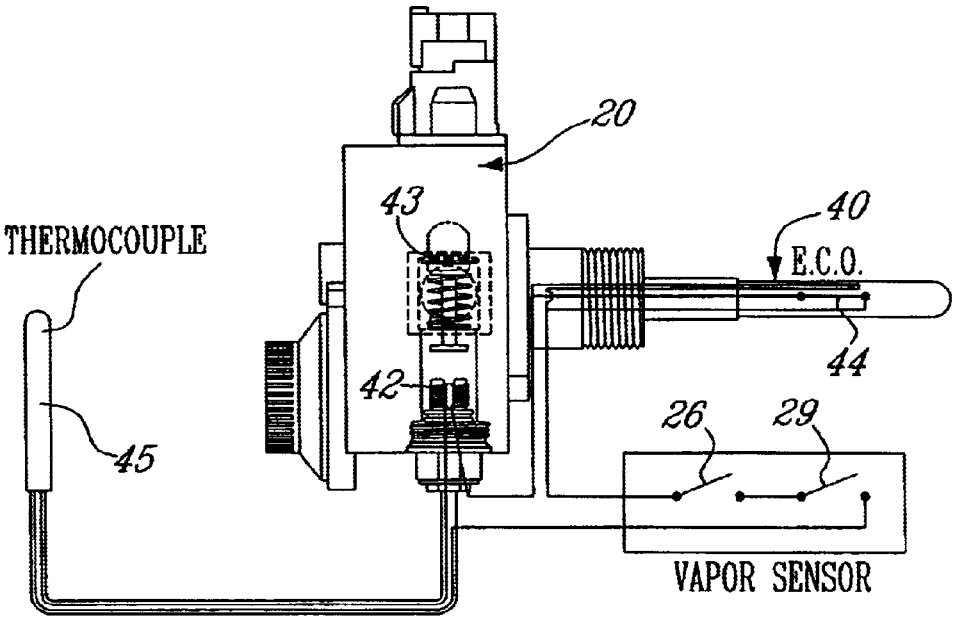
FIG. 5 is a schematic side view of a gas valve showing the connection of the vapor sensors to the relay coil of a gas valve.

Referring now to FIG. 5 there is shown a schematic illustration of the construction of the gas valve 20. This gas valve is associated with a heat detector probe 40 (ECO) which extends into the water reservoir 41 of the inner tank 12 whereby to actuate the relay coil 42 of the gas shut off valve 43 when the temperature in the water reaches a preset value. It also protects the water heater in the event of malfunction where the water temperature could reach a cut-off point, which is usually 190° F. When the hot water in the tank reaches the preset value as set by the sensor 44A in the ECO probe 40, the valve 20 shuts off the gas supply. The heat detector probe switch 44 moves to an open state causing the gas shut off valve 43 to close only in emergency situations. The thermo couple 45 is left on as it controls the valve to supply gas. It is located next to the burner. The thermo couple 45 is utilized to maintain the flame on.

As hereinshown the vapor sensors are normally open switches 26 and 29 and these are operated by a 9-volt battery or thermopile much like the fire detectors which are in common household use. When the battery or thermopile goes to a low charge an alarm is sound indicating that the battery needs to be replaced. These sensors, herein sensors 26 and 29 are connected through the high heat detector probe 40, as hereinshown, to the relay coil 42 and as soon as they are closed they energize the relay coil 42 to move the gas shut off valve 43 to a closed position whereby to cut-off the supply of gas to the pilot 18 and the burner 17.

Figure 6:
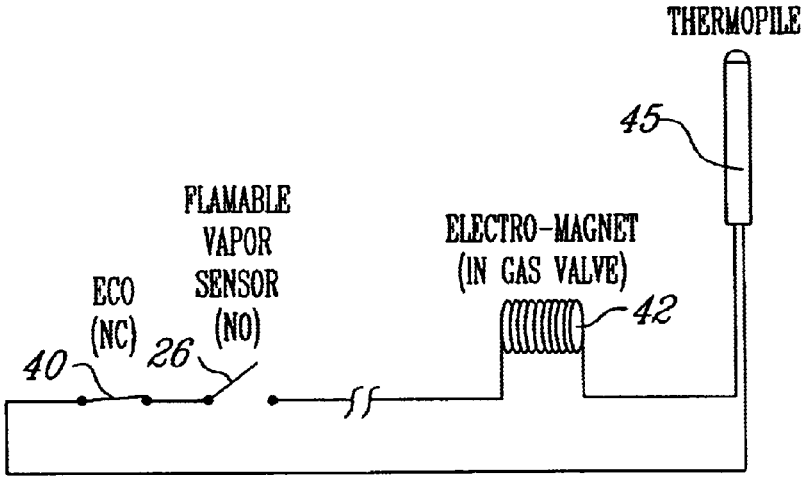
FIG. 6 is a schematic diagram showing the connection of the vapor sensor to the electromagnet of a gas valve.

FIG. 6 illustrates the connection of a vapor sensor such as vapor sensor 26 to the electromagnet or relay coils 42. The supply of the coil is by the ECO, as is obvious to a person skilled in the art.

Figure 7:
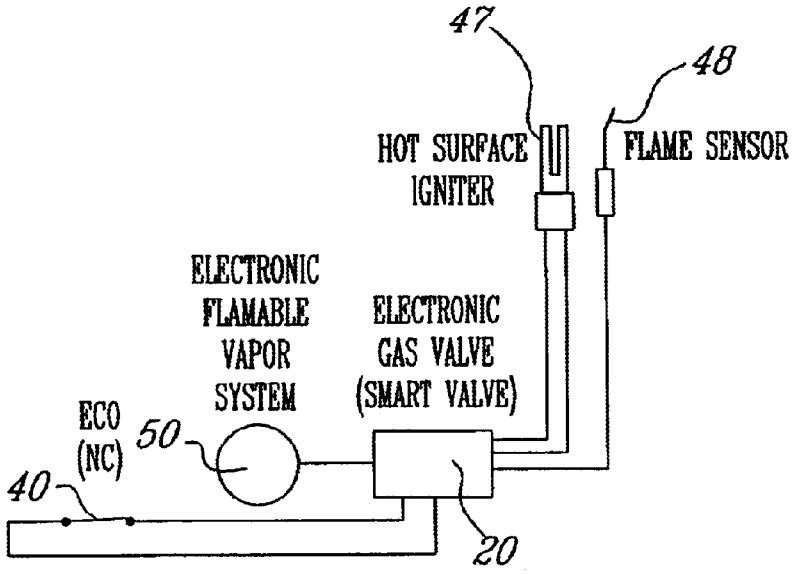
FIG. 7 is a schematic diagram showing the vapor detector system connected to the gas valve and the hot surface igniter of the burner.

FIG. 7 the use of a hot surface igniter 47 instead of a gas pilot and wherein the vapor sensor generally indicated at reference numeral 50 controls the gas valve 20 and hence the hot surface igniter 47 of the gas burner as the igniter is only provided a current when the electromagnetic valve is opened. A flame sensor 48 detects the presence of the flame. When the valve 20 is closed the igniter is off.

Figure 8:
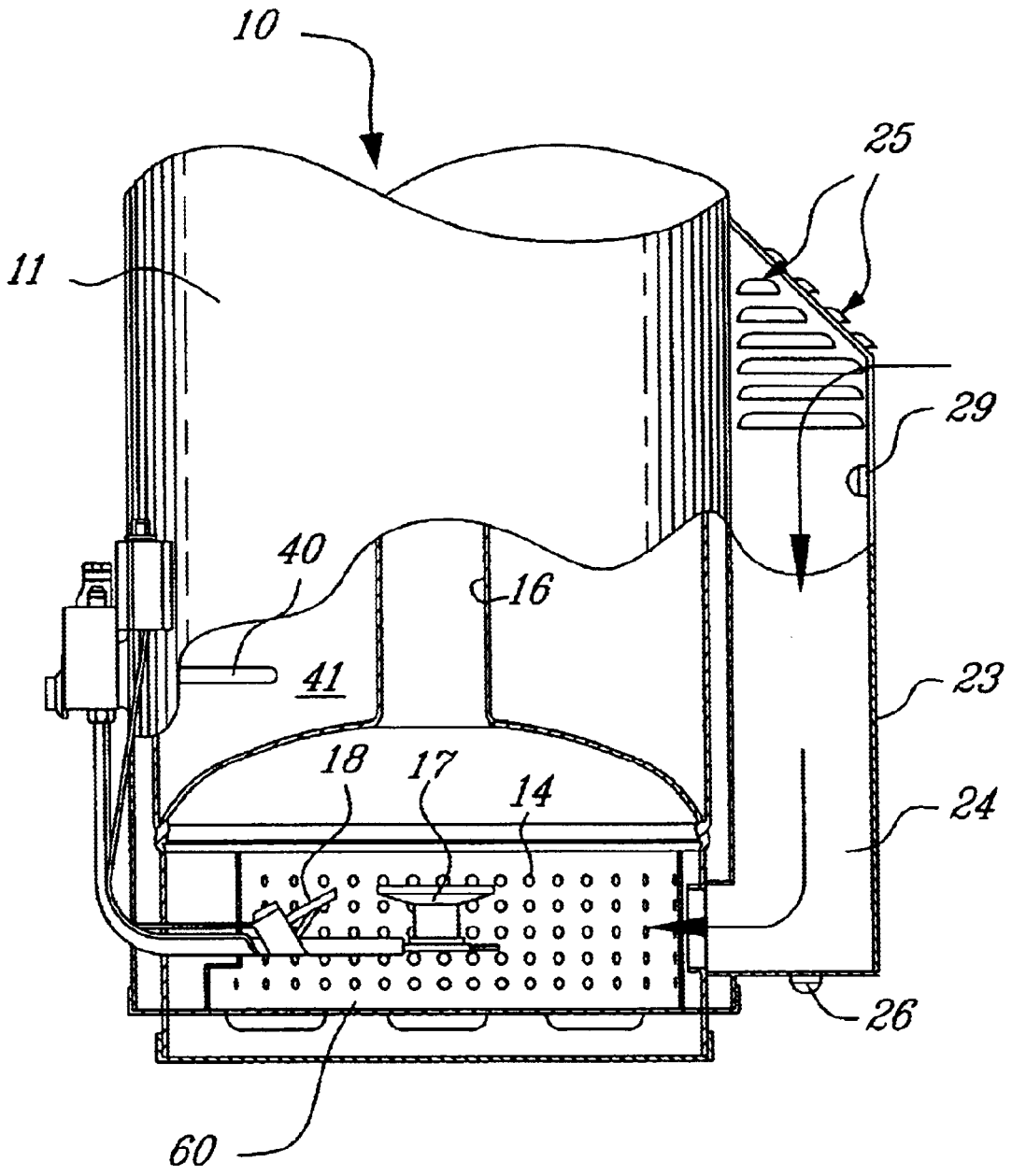
FIG. 8 is a view similar to FIG. 1 and wherein a baffle and air dispenser perforated wall is disposed about the combustion chamber to optimize gas combustion.

FIG. 8 shows a cylindrical flame arrestor and air dispenser plate 60 is disposed all around the combustion chamber 14 to optimize gas combustion whereby to achieve higher gas input. The holes 61 in the flame arrestor plate can be between ¼ of an inch to one inch in diameter. This plate provides a baffle to retard the flow of combustible fumes and at the same time provides improved air distribution and flow within the combustion chamber. It also acts as a baffle to prevent flames from exiting through the bottom and of the water heater if there is an explosion in the combustion chamber.

It is pointed out that all embodiments of the fresh air supply channels and baffles all meet the LINT tests and CSA tests and regulations.

Figure 9:
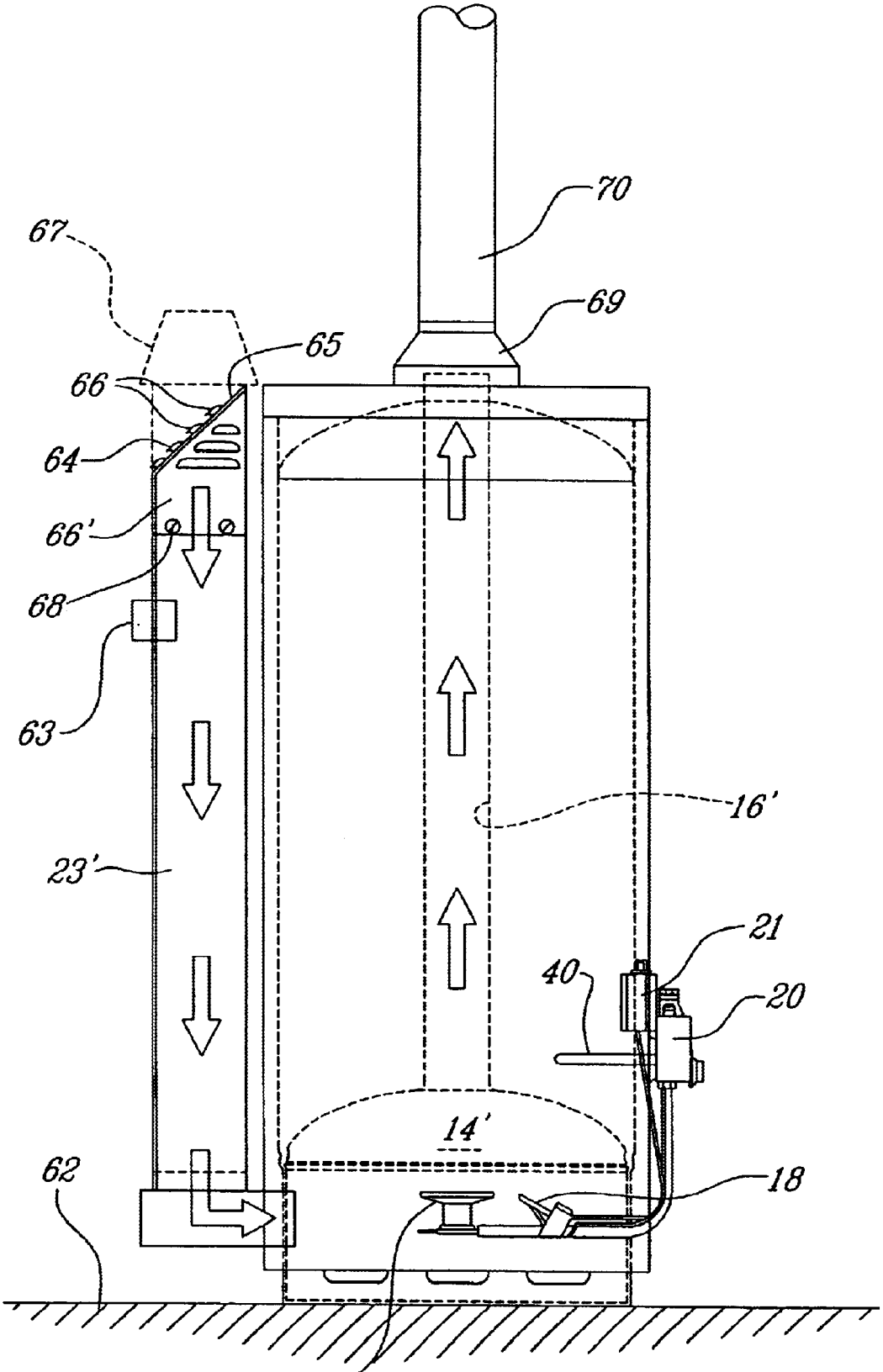
FIG. 9 is a schematic side view of a gas-fired water heater having a sealed combustion chamber and a vertical supply channel equipped with a pressure sensor safety system to shut-off the gas supply.

Referring now to FIG. 9 there is shown a further embodiment of the present invention wherein the air supply channel 23' is substantially elevated from the floor surface 62 to position its intake 64 a distance of at least 40 inches from the floor surface. The air supply intake 64 is hereinshown by the slope wall 65 having louvers 66 therein and further louvers 66' provided in the opposed side walls in the upper part of the channel 23'. The air intake 64 may also be constituted by a removable air filter 67, hereinshown in phantom lines, mounted at the top end of the air supply channel 23' or simply an opening provided with removable filters to permit ease of cleaning. The upper part of the channel may also be removable by removing screws 68 whereby the upper portion of the channel is also removable for cleaning, particularly if a fine mesh screen is provided inside the upper portion of the channel behind the louvers. Accordingly, it can be appreciated that the intake of this supply channel can be maintained substantially clean of lint at all times whereby to ensure for a proper oxygen supply to the burner chamber 14'. It is pointed out that if lint obstructs the air intake ports then the supply of oxygen is greatly diminished and the burner emits carbon monoxide which is released in the flue 16, and decreases the speed of evacuation of the combustible product with the risk of causing spillage of carbon monoxide through the draft hood 69 provided about the exit end of the flue pipe 70. This spilling in a residential household could cause death to its residents.

In order to avoid the inadequate supply of combustion air there is provided a pressure sensing means in the form of a mechanical or electronic pressure sensor 63 which is mounted in the supply pipe 23' whereby to monitor the pressure inside the pipe and compare it to outside ambient pressure. Should the air supply not be adequate, a auction will be created inside the supply pipe 23' by the up draft in the flue pipe causing a pressure differential between the air inside the air supply channel and ambient air. If these conditions continue for a predetermined time the pressure sensor will actuate the gas supply shut off valve to extinguish the burner and pilot. An audible and/or visual alarm can then be triggered to inform the occupants that the filter or the air louvers are blocked and require cleaning. It can be appreciate that the cleaning is made very accessible due to its convenient location as compared with the flame arrestor circumferential plate 60 as shown in FIG. 8. It is also pointed out that the present method of detecting the differential pressure is much more reliable than trying to detect the CO (carbon monoxide) emission content in the flue pipe which is not a very reliable method.

It is within the ambit of the present invention to cover any obvious modifications of the embodiments described herein, provided such modifications fall within the scope of the appended claims.

What is claimed is:

1. An explosion proof gas-fired water heater comprising a housing having a water reservoir and a sealed combustion chamber thereunder, a flue pipe above said combustion chamber and extending through said reservoir, a gas burner and pilot in said combustion chamber, a gas supply line having a gas supply shut-off valve secured to said burner and pilot, a sealed combustible air supply channel to supply fresh air to said combustion chamber and having an air supply intake disposed elevated from a floor surface of said water heater a distance of at least 40 inches whereby combustible vapors will not propagate to the air supply intake to enter said combustion chamber and reach said gas burner and pilot through said air supply channel and one or more vapor detectors associated with said channel to detect the presence of combustible vapors, said vapor detectors being connected to switching means to shut-off said gas burner and pilot before said combustible vapors reach said gas burner and pilot through said air supply channel.

2. An explosion proof gas-fired water heater as claimed in claim 1 wherein said at least one fresh air supply channel is constituted by one or more vertical conduits secured to an outer wall of said housing, a lower portion of said conduits connecting with said combustion chamber.

3. An explosion proof gas-fired water heater as claimed in claim 2 wherein one of said vapor detectors is secured in a lower part of said water heater whereby any detected combustible vapor will be delayed propagating to said air intake ports and said gas burner and pilot whereby said combustion chamber will have sufficient time to cool down to prevent ignition of said combustible vapor by hot metal surfaces in said combustion chamber.

4. An explosion proof gas-fired water heater as claimed in claim 1 wherein said at least one air supply channel is constituted by at least one fresh air intake port in a support base of said water heater, and two or more baffle walls spaced from one another and said fresh air intake port and said combustion chamber, said one or more vapor detector being secured adjacent said fresh air intake port.

5. An explosion proof gas-fired water heater as claimed in claim 1 wherein said vapor detector is a battery operated N.O. switch which when activated upon detection of said combustible vapors will shut off a gas supply valve to extinguish said pilot and gas burner.

6. An explosion proof gas-fired water heater as claimed in claim 1 wherein there is further provided a pressure sensing means to monitor the air pressure within said supply channel, and actuation means to shut-off said gas supply shut-off valve upon detection of a predetermined air pressure differential between ambient air pressure and air inside said supply channel over a predetermined period of time.

7. An explosion proof gas-fired water heater as claimed in claim 6, wherein said pressure sensing means is one of a mechanical or electronic pressure sensor device.

8. An explosion proof gas-fired water heater as claimed in claim 6 wherein said air supply intake is provided with a removable flame arrestor.

9. An explosion proof gas-fired water heater as claimed in claim 6 wherein said air supply intake is provided with a removable air filter.

* * * * *